US010035256B1

(12) United States Patent
Li

(10) Patent No.: US 10,035,256 B1
(45) Date of Patent: Jul. 31, 2018

(54) BUCKLING APPARATUS OF A TOOLBOX

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 0 days.

(21) Appl. No.: 15/418,977

(22) Filed: Jan. 30, 2017

(51) Int. Cl.

| | |
|---|---|
| ***B25H 3/02*** | (2006.01) |
| ***B65D 43/16*** | (2006.01) |
| ***B65D 25/28*** | (2006.01) |
| ***B65D 43/22*** | (2006.01) |

(52) U.S. Cl.
CPC ..... *B25H 3/02* (2013.01); *B65D 25/2802* (2013.01); *B65D 43/166* (2013.01); *B65D 43/22* (2013.01)

(58) Field of Classification Search
CPC . B25H 3/00; B25H 3/02; B65D 25/28; B65D 25/2802; B65D 41/18; B65D 43/16; B65D 43/166; B65D 43/22; E05B 47/00; E05B 47/0012; E05B 65/46; E05B 65/463; E05C 3/12; E05C 3/122; E05C 3/124; E05C 3/126; E05C 3/128; F24C 15/00; F24C 15/02; F24C 15/022
USPC ..... 206/372, 373; 220/324–326; 292/219–229
See application file for complete search history.

(56) References Cited

U.S. PATENT DOCUMENTS 3,208,781 A * 9/1965 Appleberry ..... E05C 3/14 292/128
8,567,631 B2 * 10/2013 Brunner ..... B25H 3/02 220/326

FOREIGN PATENT DOCUMENTS

CH 685487 A5 * 7/1995 ..... B65D 43/166

* cited by examiner

*Primary Examiner* — Bryon Gehman

(57) ABSTRACT

A buckling apparatus includes a buckle, a connector and an elastic element. The buckle includes two bores. The connector includes a main axle, two levers transversely extending from the main axle, and two external rods extending from the levers into the bores. The elastic element includes a first torque spring, a second torque spring, and an intermediate lever formed between the first and second torque springs. The first torque spring is located between and connected to the levers and adapted for biasing the buckle from the connector. The second torque spring is supported on the first lever and adapted for biasing the connector from a toolbox. The intermediate lever is placed against the first lever.

19 Claims, 9 Drawing Sheets

BUCKLING APPARATUS OF A TOOLBOX

BACKGROUND OF INVENTION

1. Field of Invention

The present invention relates to a toolbox and, more particularly, to a buckling apparatus for a toolbox.

2. Related Prior Art

A tool box for containing manual and/or electric tools, screwdrivers and/or sockets. A toolbox includes a casing, a cover pivotally connected to the shell, and at least one buckling apparatus operable to lock the cover on the casing. That is, the tools are kept in the closed toolbox.

A typical buckling apparatus includes a block formed on the cover, a rib formed on the casing, a connector pivotally connected to the rib, and a buckle pivotally connected to the connector. The distance between the block and the rib is marginally larger than the length of the buckle minus that of the connector. The buckle is pivoted between a locking and an unlocking position. In the locking position the buckle is overlapped with the connector to engage the buckle with the block. In the unlocking position, the buckle is not overlapped with the connector to disengage the buckle from the block.

As disclosed in U.S. Pat. No. 7,568,739 issued to the present applicant, a toolbox includes two interconnected casings 10 and 20, a locking unit 60 attached to the casing 20, and a snapping unit 30 attached to the casing 10 and operable to engage with the locking unit 60 to keep the casings 10 and 20 closed. The snapping unit 30 includes a seat 31, a pivotal member 34, two torsion springs 40 and a snapping member 50. The seat 31 is formed on the casing 10. The pivotal member 34 is pivotally connected to the seat 31 by inserting a pivot shaft 37 in the pivotal member 34 and a C-shaped hole 32 made in the seat 31. The pivotal member 34, the torsion springs 40 and the snapping element 50 are interconnected by inserting a pivot shaft 38 in the seat 34, helical portions of the torsion springs 40 and two bores 51 made in the snapping element 50. However, the snapping unit 30 could easily fail because the pivot shaft 37 could easily be removed from the C-shaped hole 32. Moreover, it is troublesome to assembly the snapping unit 30 because the pivot shaft 38 must be inserted in two individual torsion springs 40.

The present invention is therefore intended to obviate or at least alleviate the problems encountered in prior art.

SUMMARY OF INVENTION

It is the primary objective of the present invention to provide a toolbox with an inexpensive and reliable buckling apparatus.

To achieve the foregoing objective, the buckling apparatus includes a buckle, a connector and an elastic element. The buckle includes two bores. The connector includes a main axle, two levers transversely extending from the main axle, and two external rods extending from the levers into the bores. The elastic element includes a first torque spring, a second torque spring, and an intermediate lever formed between the first and second torque springs. The first torque spring is located between and connected to the levers and adapted for biasing the buckle from the connector. The second torque spring is supported on the first lever and adapted for biasing the connector from a toolbox. The intermediate lever is placed against the first lever.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
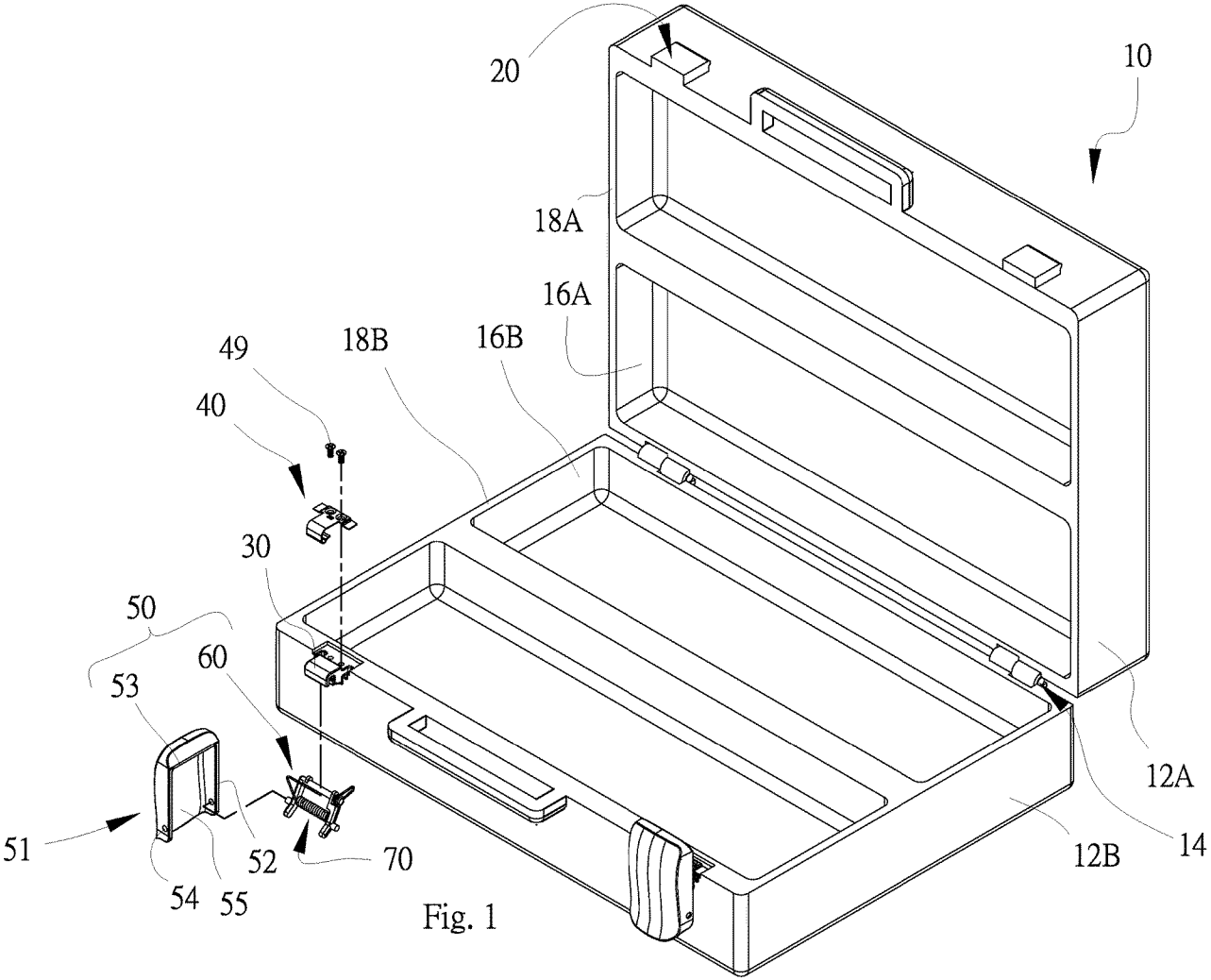
FIG. 1 is a perspective view of a toolbox equipped with two buckling apparatuses according to the preferred embodiment of the present invention.
Figure 2:
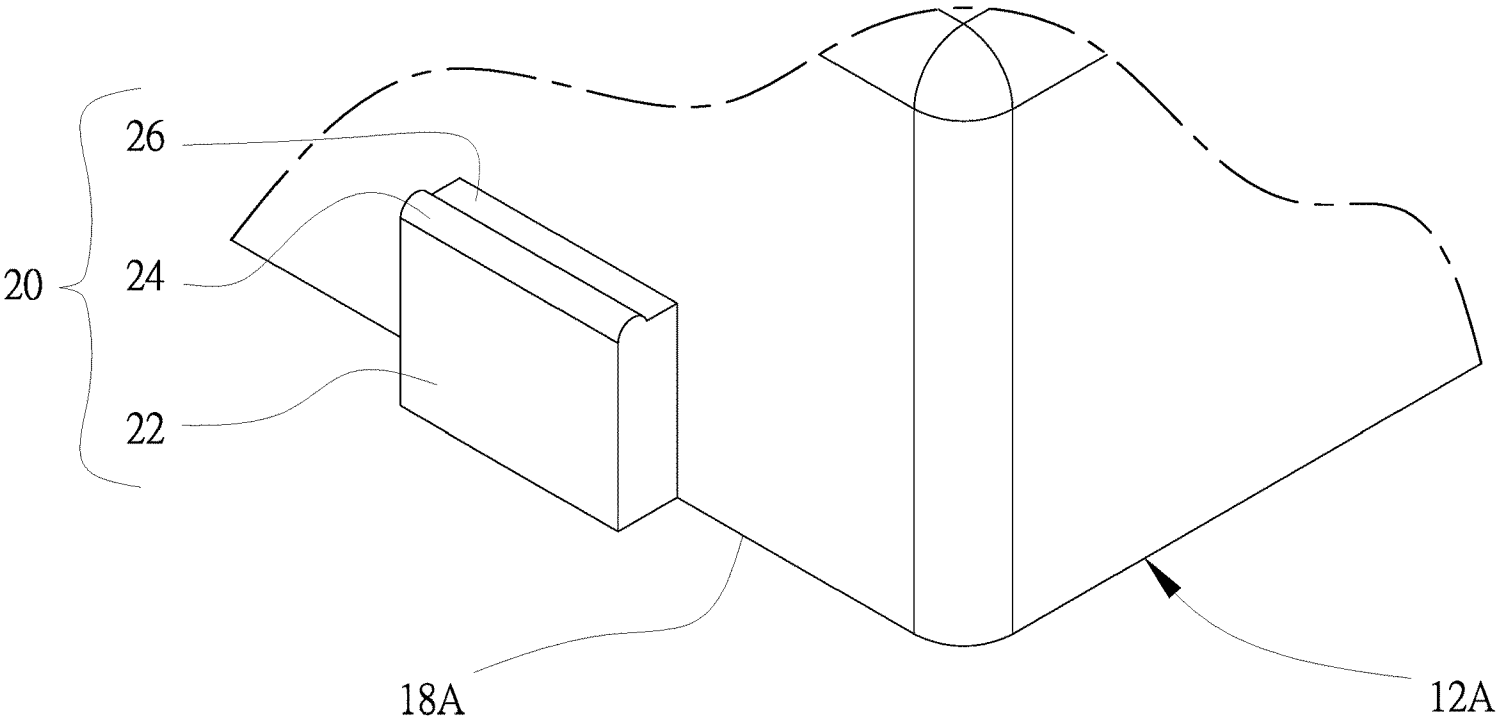
FIG. 2 is a perspective view of an engagement element of the toolbox shown in FIG. 1.
Figure 4:
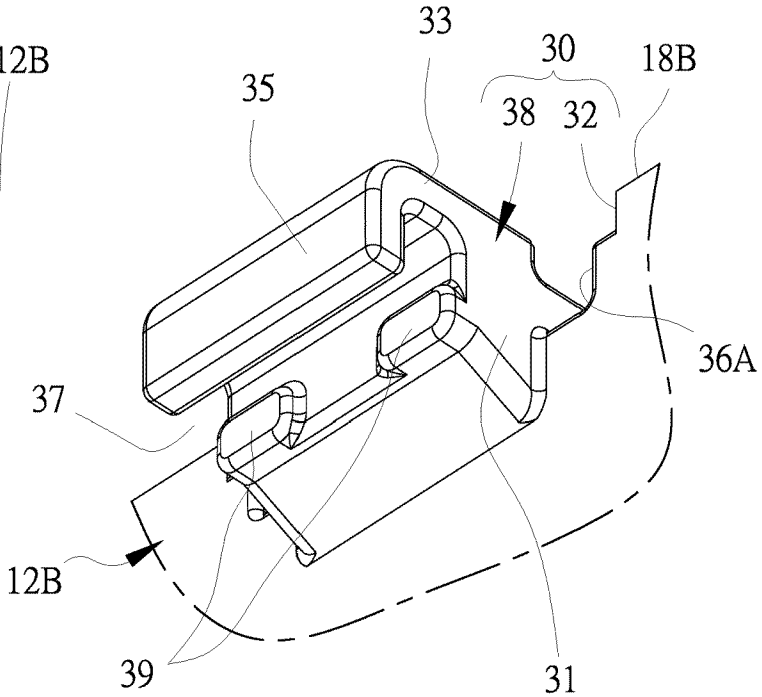
FIG. 4 is a perspective view of the supporting unit shown in FIG. 3.
Figure 3:
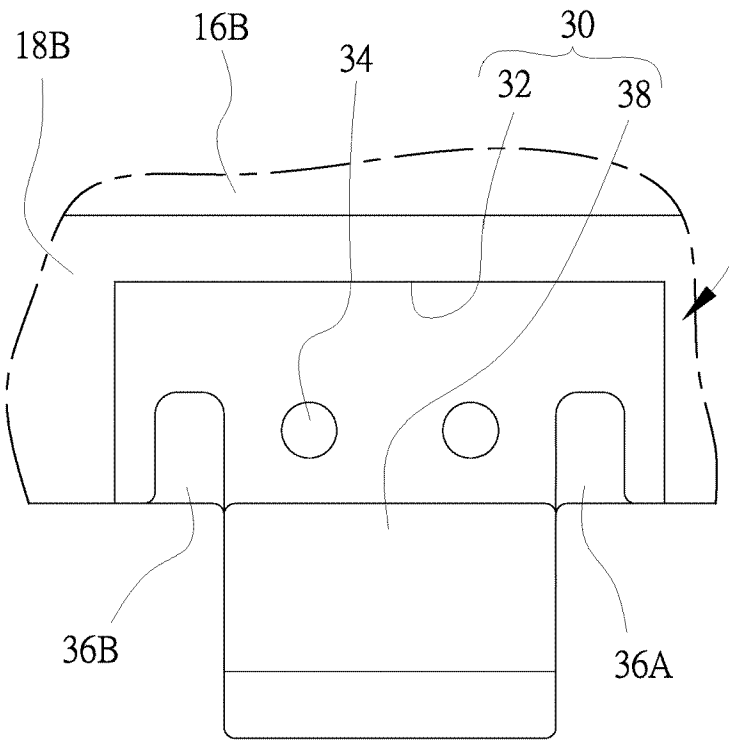
FIG. 3 is a top view of a supporting unit of the toolbox of FIG. 1.
Figure 5:
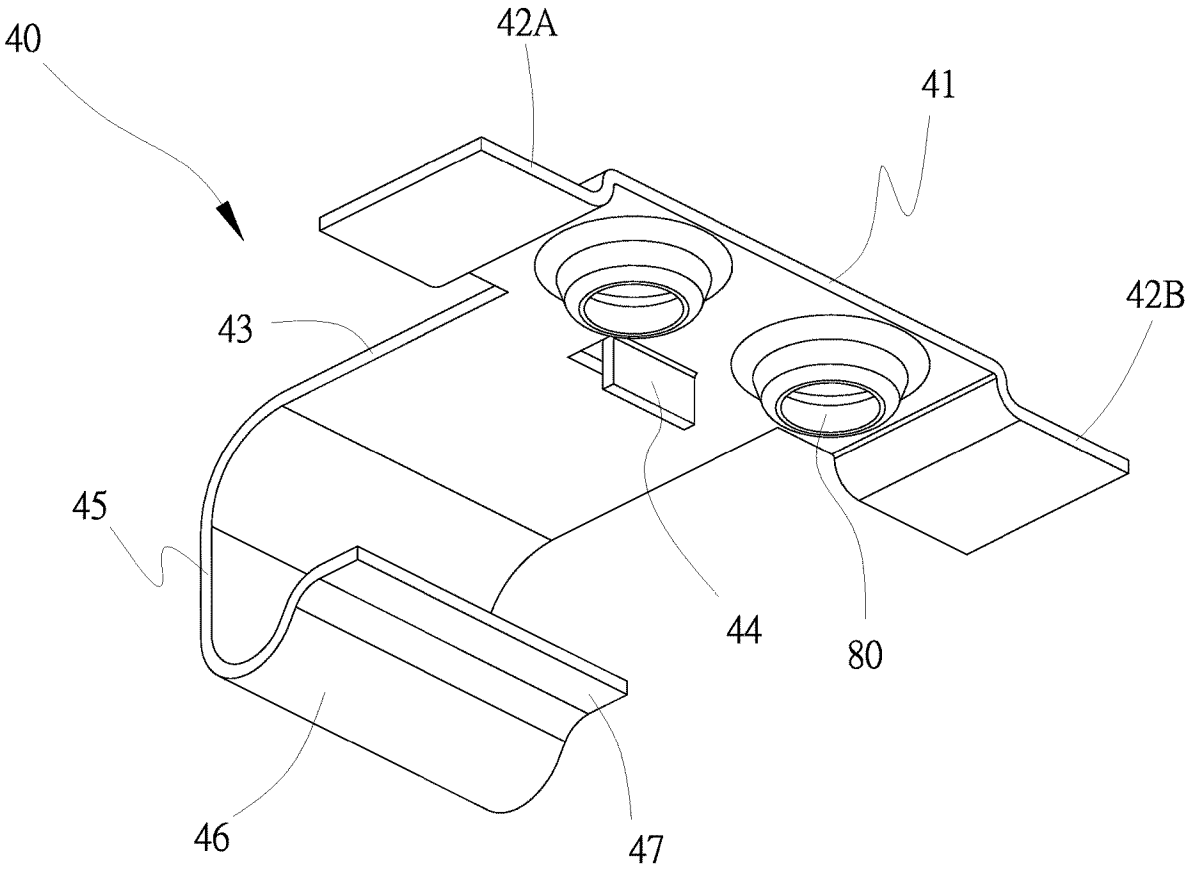
FIG. 5 is a perspective view of a restraint of the toolbox of FIG. 1.
Figure 6:
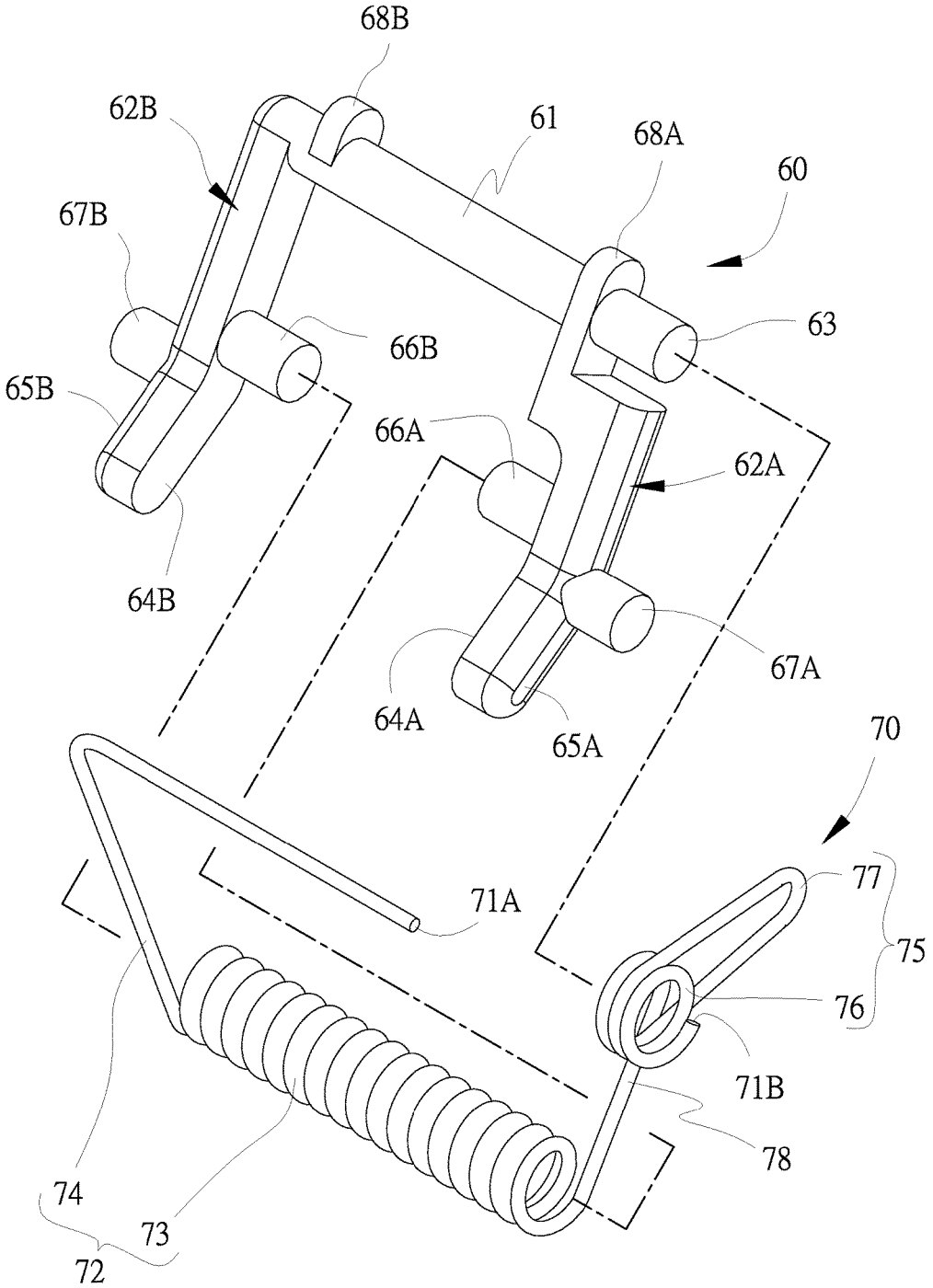
FIG. 6 is a perspective view of a connector and an elastic element of one of the buckling apparatuses shown in FIG. 1.
Figure 8:
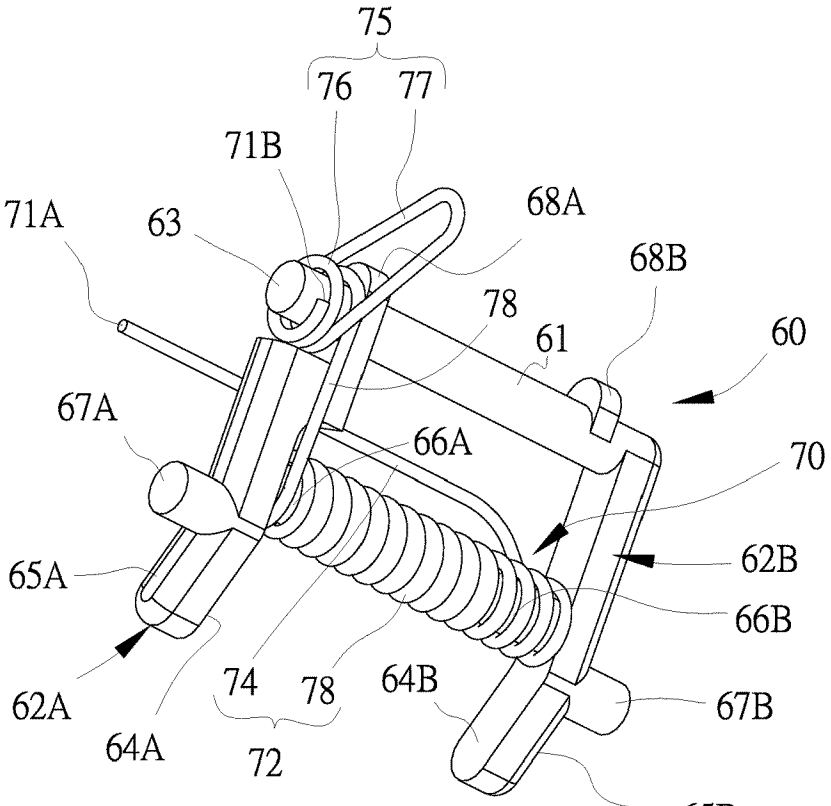
FIG. 8 is a perspective view of the elastic element supported on the connector shown in FIG. 6.
Figure 7:
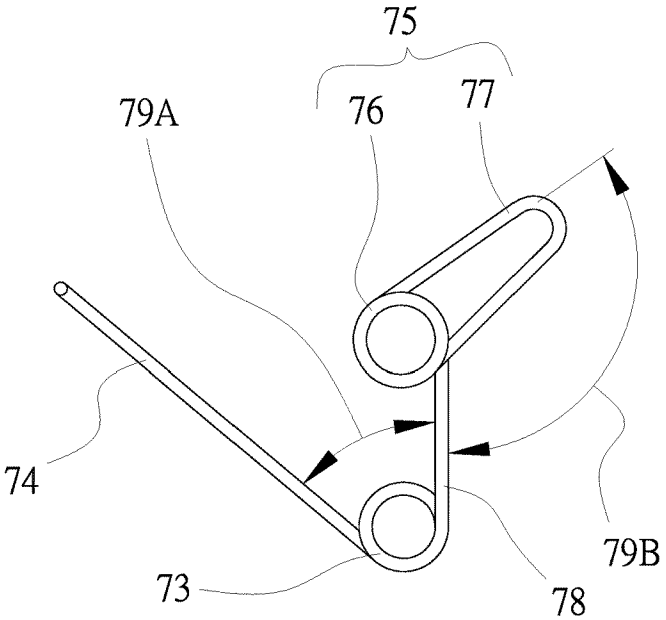
FIG. 7 is a side view of the elastic element shown in FIG. 6.

Referring to FIG. 1, a toolbox 10 includes two shells 12A and 12B, two engagement elements 20, two supporting units 30, two restraints 40 and two buckle units 50 according to the preferred embodiment of the present invention. The shells 12A and 12B is pivotally connected to each other by two hinges 14, thereby rendering the shells 12A and 12B rotatable about the hinges 14 between an opened position and a closed position.

In the closed position, an edge 18A of the shell 12A is in contact with an edge 18B of the shell 12B. The shell 12A includes two compartments 16A. The shell 12B includes two compartments 16B. Now, each of the compartments 16A and a corresponding one of the compartments 16B become one when the shells 12A and 12B are in the closed position.

In the opened position, the shells 12A and 12B are pivoted from each other. Thus, manual tools, electric tools and bits such as screwdrivers and sockets can be put in or taken from the compartments 16A and 16B.

The buckle units 50 can be pivoted between a locking position and an unlocking position. In the locking position, the buckle units 50 are engaged with the engagement elements 20 to keep the shells 12A and 12B in the closed position. In the unlocking position, the buckle units 50 are disengaged from the engagement elements 20 to allow the shells 12A and 12B to be pivoted to the opened position.

Each of the engagement elements 20, a corresponding one of the supporting units 30, a corresponding one of the restraints 40 and a corresponding one of the buckle units 50 are used together. Hence, the following description will be given to only one engagement element 20, one supporting unit 30, one restraint 40 and one buckle unit 50 for briefness and clarity.

Referring to FIGS. 1 to 5, the engagement element 20 is formed on a portion of the shell 12A, opposite to the hinges 14. The engagement element 20 includes a block 22, a ridge 24 and a gap 26. The block 22 is formed on a front face of the shell 12A so that they are made in one piece. The ridge 24 is formed on an upper face of the block 22. The ridge 24 is separated from the front face of the shell 12A by the gap 26.

The supporting unit 30 is formed on a portion of the shell 12B, opposite to the hinges 14. The supporting unit 30 includes a cavity 32 and a bearing 38. The cavity 32 is made in the edge of the shell 12B. There are two recesses 36A and 36B in the floor of the cavity 32. That is, the recesses 36A and 36B are deeper than the cavity 32.

The bearing 38 is in the form of a claw including a supporting portion 31, a horizontal portion 33, a vertical portion 35 and two bosses 39. The supporting portion 31 is formed on a front face of the shell 12B so that they are made in one piece. The horizontal portion 33 extends from the supporting portion 31. The vertical portion 35 extends from the horizontal portion 33 transversely. The bosses 39 extend from the supporting portion 31. Thus, there is a semi-tubular space 37 amid the supporting portion 31, the horizontal portion 33, the vertical portion 35 and the bosses 39.

The restraint 40 includes an upper horizontal portion 41, two lower horizontal portions 42A and 42B, a horizontal extensive portion 43, a tab 44, a vertical portion 45, an arched portion 46 and a terminal portion 47. The lower horizontal portions 42A and 42B extend from two opposite edges of the upper horizontal portion 41. The horizontal extensive portion 43 extends from the upper horizontal portion 41 in a same plane. The tab 44 transversely extends from the upper horizontal portion 41. The vertical portion 45 transversely extends from the horizontal extensive portion 43. The arched portion 46 extends from the vertical portion 45. Horizontally, the terminal portion 47 extends from the arched portion 46.

Referring to FIGS. 6 through 10, the buckle unit 50 includes a buckle 51, a connector 60 and an elastic element 70. The buckle 51 includes a flat body 56, a hook 53, a handle 57 and two lateral walls 52. The flat body 56 is made with an internal face 55. The hook 53 is formed at an end of the flat body 56 while the handle 57 is formed at another end of the flat body 56. The lateral walls 52 are formed at two opposite edges of the flat body 56. Each of the lateral walls 52 includes a bore 54 so that the bores 54 face each other.

The connector 60 includes a main axle 61, a secondary axle 63, two levers 62A and 62B, two internal rods 66A and 66B, two external rods 67A and 67B and two stops 68A and 68B. The secondary axle 63 axially extends from an end of the main axle 61. Each of the levers 62A and 62B transversely extends from an end of the secondary axle 63. The lever 62A includes an intermediate portion transversely formed between two terminal portions. The internal rod 66A transversely extends from an internal face 64A of the lever 62A. The internal rod 66B transversely extends from an internal face 64B of the lever 62B. The external rod 67A transversely extends from an external face 65A of the lever 62A. The external rod 67B transversely extends from an external face 65B of the lever 62B. The stops 68A and 68B transversely extend from the main axle 61, opposite to the levers 62A and 62B.

The elastic element 70 is made of a metal string and includes two torque springs 72 and 75. The torque spring 72 includes a helical portion 73, and a lever 74 extending from the helical portion 73. The lever 74 preferably includes a bent end 71A. The torque spring 75 includes a helical portion 76, a lever 77 extending from the helical portion 76, and an end 71B extending from the lever 77. A lever 78 is formed between the helical portion 73 and 76. There is an angle 79A between the levers 74 and 78. There is an angle 79B between the levers 77 and 78.

The elastic element 70 is supported on the connector 60. The helical portion 73 is supported on the internal rods 66A and 66B. The helical portion 76 is supported on the secondary axle 63. The lever 78 includes a portion placed against the internal face 64A of a terminal portion of the lever 62A and another portion placed against the external face 65A of the remaining terminal portion of the lever 62A.

The connector 60 is connected to the buckle 50. The external rods 67A and 67B are inserted in the bores 54. Tips of the first levers 62A and 62B are placed against the internal face 55. The bent end 71A of the lever 74 is also placed against the internal face 55.

Figure 10:
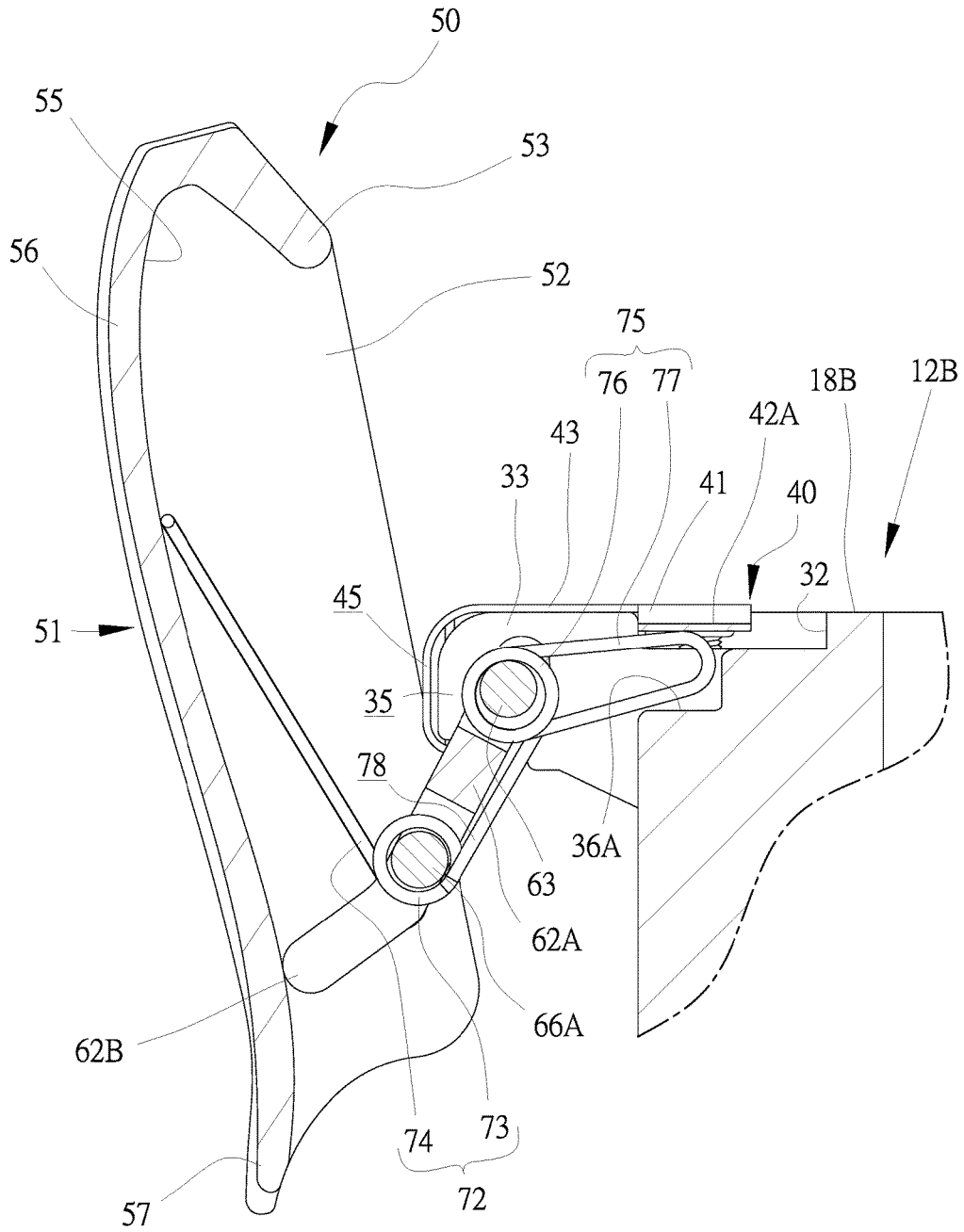
FIG. 10 is another cross-sectional view of the buckling apparatus shown in FIG. 9.

The connector 60 is connected to the supporting unit 30. The main axle 61 is inserted in the semi-tubular space 37, thereby rendering the connector 60 rotatable on the supporting unit 30. The connector 60 is not rectilinear movable relative to the supporting unit 30 because the horizontal portion 33 of the bearing 38 is kept between the stops 68A and 68B. A portion of the lever 77 is inserted in the recess 36A (FIG. 10). The portion of the lever 77 is kept in the recess 36A by the lower horizontal portion 42A of the restraints 40. The portion of the lever 77 is firmly placed against a portion of the shell 12B.

In another embodiment, the secondary axle 63 is located on the external face of the lever 62B, and the positions of the levers 74 and 78 relative to the helical portion 73 of the torque spring 72 are exchanged. Thus, the lever 77 is inserted in the recess 36B.

The main axle 61 is kept in the semi-tubular space 37 by the restraint 40, which is located on the engagement element 30 and attached to the shell 12B. The upper horizontal portion 41 covers the cavity 32. Two screws 49 are inserted in two screw holes 34 made in the shell 12B via two apertures 80 made in the upper horizontal portion 41 of the restraint 40, thereby connecting the restraint 40 to the shell 12B. The lower horizontal portions 42A and 42B are respectively inserted in the recesses 36A and 36B. The horizontal extensive portion 43 covers the horizontal portion 33. The tab 44 is placed against the supporting portion 31. The vertical portion 45 and the arched portion 46 cover the vertical portion 35. The terminal portion 47 extends in the semi-tubular space 37. An upper face of the terminal portion 47 is in contact with the main axle 61. A lower face of the terminal portion is in contact with the bosses 39.

The elastic element 70 tends to pivot the buckle 51 from the shell 12B because the bent end 71A of the lever 74 is placed against the internal face 55 and the lever 77 is placed against the shell 12B.

Figure 9:
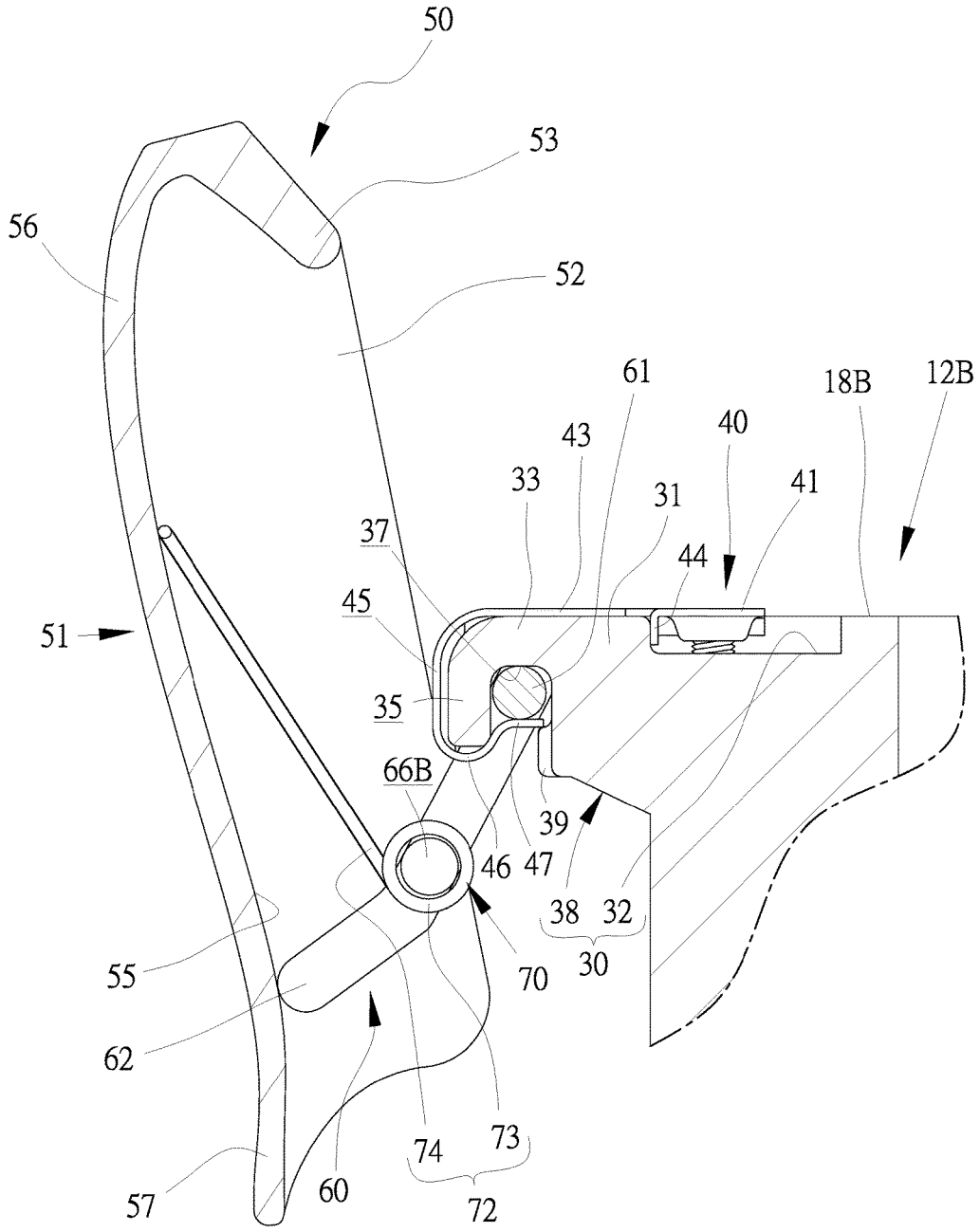
FIG. 9 is a cross-sectional view of one of the buckling apparatuses shown in FIG. 1.

Referring to FIG. 9, the shells 12A and 12B are in the opened position. The hook 53 of the buckle 51 is disengaged from the ridge 24 of the engagement element 20.

Figure 11:
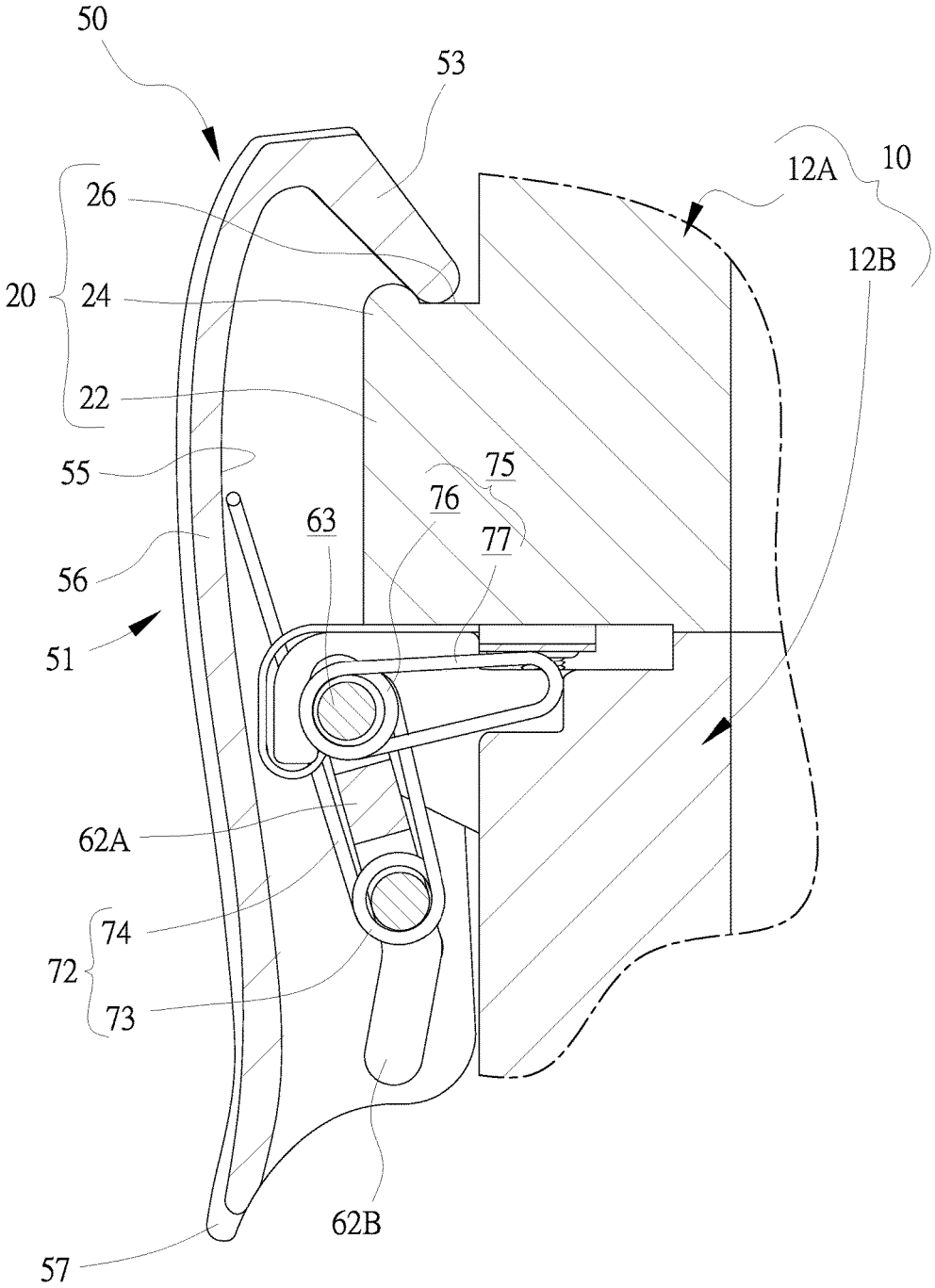
FIG. 11 is a cross-sectional view of the buckling apparatus in another position than shown in FIG. 9.

Referring to FIG. 11, the shells 12A and 12B are in the closed position. The hook 53 of the buckle 51 is engaged with the ridge 24 of the engagement element 20, thereby keeping the shells 12A and 12B in the closed position. The angle 79A between the levers 74 and 78 is reduced and the angle 79B between the levers 77 and 78 is increased. Thus, the elastic element 70 is loaded and ready to pivot the buckle 51 from the supporting unit 30 when the handle 57 is operated to lift the buckle 51.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A buckling apparatus comprising:

a buckle comprising two bores;

a connector comprising a main axle connected to a toolbox, first and second levers transversely extending from the main axle, and two external rods each extending into a corresponding one of the bores of the buckle from a corresponding one of the first and second levers; and an elastic element comprising a first torque spring, a second torque spring, and an intermediate lever formed between the first and second torque springs, wherein the first torque spring is located between and connected to the first and second levers and adapted for biasing the buckle from the connector, wherein the second torque spring is supported on the first lever and adapted for biasing the connector from the toolbox, wherein the intermediate lever is placed against the first lever.

2. The buckling apparatus according to claim 1, wherein the connector further comprises two internal rods extending from the first and second levers, wherein the first torque spring comprises a helical portion supported on and around the internal rods and a terminal lever placed against the buckle, wherein the terminal lever and the intermediate lever extend from opposite ends of the helical portion.

3. The buckling apparatus according to claim 2, wherein the buckle comprises a flat body, two lateral walls formed at two opposite edges of the flat body, a hook formed at an end of the flat body, and an internal face made amid the flat body, the lateral walls and the hook, wherein the terminal lever is placed against the internal face of the buckle, wherein the bores are made in the lateral walls of the buckle.

4. The buckling apparatus according to claim 1, wherein the connector further comprises a secondary axle transversely extending from the first lever, wherein the second torque spring comprises a helical portion supported on and around the secondary axle and a terminal lever placed against the toolbox, wherein the terminal lever of the second torque spring and the intermediate lever extend from two opposite ends of the helical portion.

5. The buckling apparatus according to claim 4, wherein the main and secondary axles extend coaxially.

6. The buckling apparatus according to claim 1, wherein the first lever comprises two terminal portions and an intermediate portion formed transversely between the terminal portions, wherein the intermediate lever comprises a portion placed against an internal face of a terminal portion of the first lever and another portion placed against an external face of the remaining terminal portion of the first lever.

7. A toolbox comprising:

two shells;

at least one hinge for pivotally connecting the shells to each other;

at least one engagement element formed on one of the shells;

at least one supporting unit formed on the remaining one of the shells; and at least one buckling apparatus according to claim 1 movable between a locking position for keeping the shells closed and an unlocking position for allowing the shells to be opened.

8. The toolbox according to claim 7, wherein the at least one engagement element comprises a block formed on a portion of the corresponding shell opposite to the hinge, a ridge formed on the block, and a gap for separating the ridge from the corresponding shell, wherein the ridge is engaged with the buckle of the least one buckling apparatus in the locking position.

9. The toolbox according to claim 7, wherein the at least one supporting unit comprises a bearing for holding the main axle.

10. The toolbox according to claim 9, wherein the connector further comprises two stops formed on the main axle, wherein the bearing is confined between the stops.

11. The toolbox according to claim 9, wherein the bearing comprises a supporting portion formed on the corresponding shell, a horizontal portion transversely extending from the supporting portion, a vertical portion transversely extending from the horizontal portion, and a semi-tubular space made by the supporting portion, the horizontal portion and the vertical portion, wherein the main axle is inserted in the semi-tubular space.

12. The toolbox according to claim 11, wherein the at least one supporting unit further comprises a cavity near the supporting portion thereof and at least one recess near the cavity, wherein the second torque spring comprises a portion inserted in the at least one recess.

13. The toolbox according to claim 12, wherein the at least one recess is deeper than the cavity.

14. The toolbox according to claim 9, wherein the at least one supporting unit further comprises a restraint for locking the main axle to the bearing.

15. The toolbox according to claim 14, wherein the at least one supporting unit comprises a supporting portion formed on the corresponding shell, a horizontal portion transversely extending from the supporting portion, a vertical portion transversely extending from the horizontal portion, and a semi-tubular space made by the supporting portion, the horizontal portion and the vertical portion, wherein the main axle is inserted in the semi-tubular space.

16. The toolbox according to claim 15, wherein the at least one supporting unit further comprises a cavity in the vicinity of the supporting portion and at least one recess next to the cavity, wherein the second torque spring comprises a portion inserted in the at least one recess.

17. The toolbox according to claim 16, wherein the restraint comprises an upper horizontal portion for covering the cavity and at least one lower horizontal portion for covering the portion of the second torque spring.

18. The toolbox according to claim 17, wherein the restraint further comprises a horizontal extensive portion extending from the upper horizontal portion, a vertical portion transversely extending from the horizontal extensive portion, an arched portion extending from the vertical portion thereof, and a terminal portion extending from the arched portion, wherein the horizontal extensive portion of the restraint covers the horizontal portion of the bearing, wherein the vertical portion of the restraint covers the vertical portion of the bearing, wherein the arched portion of the restraint covers a tip of the bearing, wherein the terminal portion of the restraint contacts and hence keeps the main axle in semi-tubular space.

19. The toolbox according to claim 18, wherein the bearing further comprises two bosses formed on the supporting portion, wherein the terminal portion of the restraint is in contact with the bosses.

* * * * *